US007686180B1

(12) United States Patent
MacDonald et al.

(10) Patent No.: US 7,686,180 B1
(45) Date of Patent: Mar. 30, 2010

(54) PIVOTED TRAY STORAGE APPARATUS

(76) Inventors: Kenneth S. MacDonald, 143 Summer St., Waterton, MA (US) 02472; Anne-Marie MacDonald, 1143 Summer St., Waterton, MA (US) 02472

( * ) Notice: Subject to any disclaimer, the term of this patent is extended or adjusted under 35 U.S.C. 154(b) by 243 days.

(21) Appl. No.: 11/624,154

(22) Filed: Jan. 17, 2007

(51) Int. Cl.
*B65D 21/02* (2006.01)

(52) U.S. Cl. ..... 220/23.83; 206/372; 206/373; 220/4.27; 220/503; 220/504

(58) Field of Classification Search ..... 132/315; 190/32; 206/373, 581, 747, 748; 211/131.1, 211/163; 220/4.01, 4.03, 4.26, 4.27, 23.4, 220/23.6, 23.86, 345.1, 817, 819, 820, 822, 220/826; 312/201, 202, 272, 273
See application file for complete search history.

(56) References Cited

U.S. PATENT DOCUMENTS 6,648,390 B1 11/2003 Yang
2003/0015446 A1 1/2003 Talbot

*Primary Examiner*—Anthony Stashick
*Assistant Examiner*—Elizabeth Volz
(74) *Attorney, Agent, or Firm*—Crossley Patent Law; Mark A. Crossley

(57) ABSTRACT

A pivoted tray storage apparatus having a parallelepiped base, the base having a base compartment. Each base end has a concave endpiece. A shelf is extended from the bottom of each concave endpiece, a pneumatic cylinder vertically disposed upon each shelf. A pair of opposed pivoted trays with compartments are pivotally disposed above the base, each tray outer end having a convex endpiece for fit to the base concave endpieces. Each tray convex endpiece is fitted with a plunger for fit to the pneumatic cylinders, respectively, providing cushioned up and down travel of trays. Trays are selectively held in an open position by a channel in each base endpiece and a spine in each tray endpiece. Further pairs of trays are optionally provided to pivotally fit above the first tray pair, successively.

20 Claims, 4 Drawing Sheets

PIVOTED TRAY STORAGE APPARATUS

BACKGROUND OF THE INVENTION

The desirability of storage containers for various objects, tools, and the like is well established. Further, containers have evolved to include those which offer both aesthetic appeal and function. The usefulness of a container is improved with increased container compartment access, coupled with the ability to close all compartments to effectively house items therein selectively. The present apparatus provides a uniquely appealing and effective container which opens to provide full access to all interior compartments.

FIELD OF THE INVENTION

The pivoted tray storage apparatus relates to containers and more especially to a storage apparatus with a base with pivoted trays above.

DESCRIPTION OF THE PRIOR ART

Prior related art does not provide a storage device that combines the functional and aesthetic appeal of the present apparatus. For example, U.S. Pat. Pub. No. 2003/0015446 filed by Talbot and published on Jan. 23, 2003 teaches a rotating tray device wherein pie-slice shaped sections are available for storage item insertion and extraction. The device does not have rotatingly extended compartments as does the present apparatus. U.S. Pat. No. 5,799,787 issued to Talbot on Sep. 1, 2001 teaches another storage device with pie-slice shaped access. U.S. Pat. No. 6,648,390 issued to Yang on Nov. 18, 2003 teaches a single-stack with single-pivot capability. Each base holds a removable tray.

While the above-described devices fulfill their respective and particular objects and requirements, they do not describe a pivoted tray storage apparatus that provides for the advantages of the pivoted tray storage apparatus. In this respect, the pivoted tray storage apparatus substantially departs from the conventional concepts and designs of the prior art. Therefore, a need exists for an improved pivoted tray storage apparatus.

SUMMARY OF THE INVENTION

The general purpose of the pivoted tray storage apparatus, described subsequently in greater detail, is to provide a pivoted tray storage apparatus which has many novel features that result in an improved pivoted tray storage apparatus which is not anticipated, rendered obvious, suggested, or even implied by prior art, either alone or in combination thereof.

To attain this, the pivoted tray storage apparatus comprises a base with a pair of opposed trays pivotally and selectively positioned above. The pivotal capability of each tray provides for compartments within the base and the trays to be fully exposed when desired, thereby providing complete access to all items within. Further, when the first pair of trays are in the fully opened position, they are selectively locked by convex and concave end pieces in the open position. Lifting a tray provides for disengagement of the fixed open position. Latches selectively secure trays in the closed position.

Trays and bases are provided in various sizes. Further, more than one pair of trays is optionally provided above the base, with each added pair of trays pivotally stacked upon the lower first pair. The apparatus is provided in embodiments comprised of wood, plastics, polymers, extrusions, injection molds, and various metals.

Thus has been broadly outlined the more important features of the improved pivoted tray storage apparatus so that the detailed description thereof that follows may be better understood and in order that the present contribution to the art may be better appreciated.

An object of the pivoted tray storage apparatus is to provide secure item storage.

Another object of the pivoted tray storage apparatus is to provide ready access to all items stored.

A further object of the pivoted tray storage apparatus is to for selectively holding of trays in the open position.

An added object of the pivoted tray storage apparatus is to provide various sizes of the apparatus.

Additionally, an object of the pivoted tray storage apparatus is to provide various heights of bases and trays.

And, an object of the pivoted tray storage apparatus is to optionally provide for more than two pivoted trays.

These together with additional objects, features and advantages of the improved pivoted tray storage apparatus will be readily apparent to those of ordinary skill in the art upon reading the following detailed description of presently preferred, but nonetheless illustrative, embodiments of the improved pivoted tray storage apparatus when taken in conjunction with the accompanying drawings.

In this respect, before explaining the current embodiments of the improved pivoted tray storage apparatus in detail, it is to be understood that the pivoted tray storage apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved pivoted tray storage apparatus. It is therefore important that the claims be regarded as including such equivalent constructions insofar as they do not depart from the spirit and scope of the pivoted tray storage apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the pivoted tray storage apparatus generally designated by the reference number 10 will be described.

Figure 1:
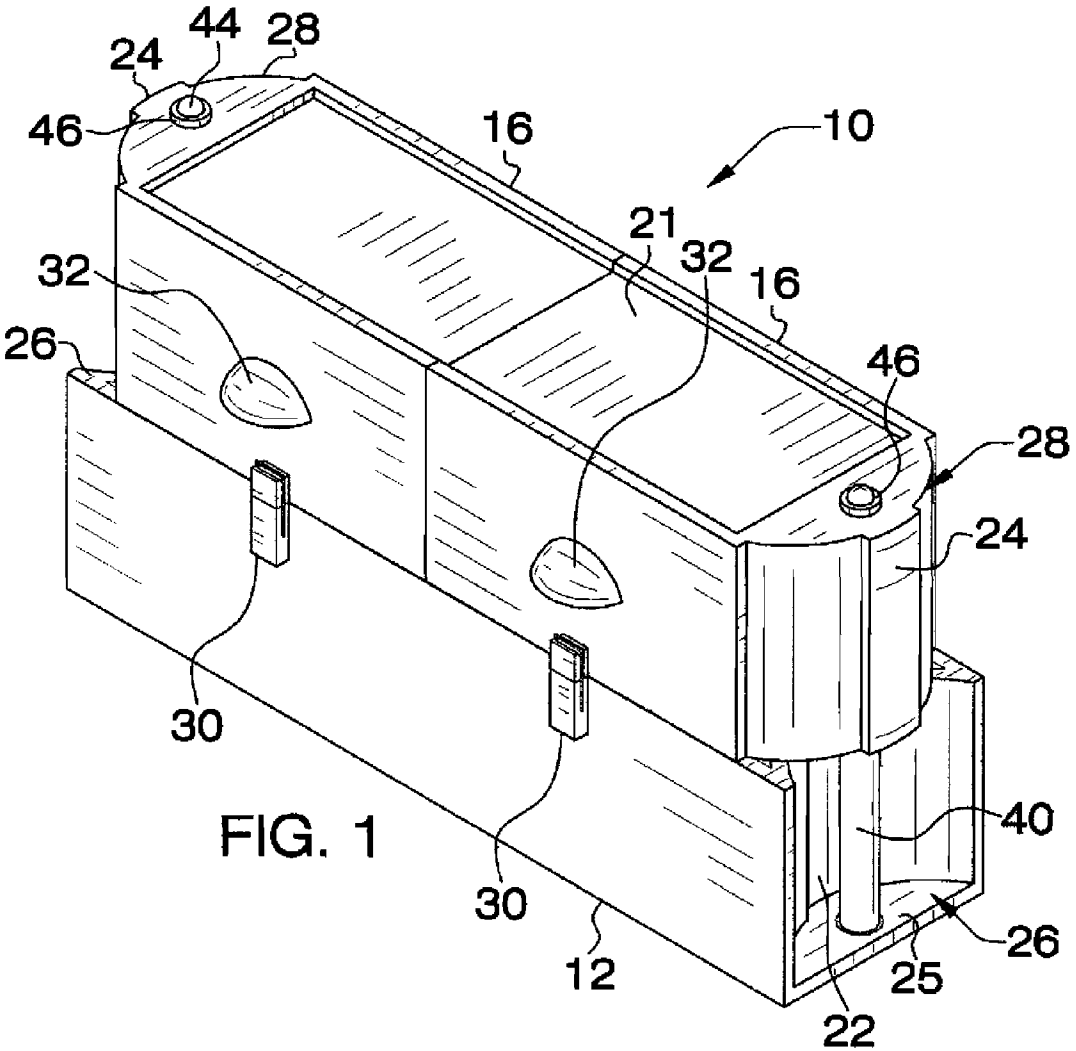
FIG. 1 is a perspective view of the closed and latched apparatus.
Figure 2:
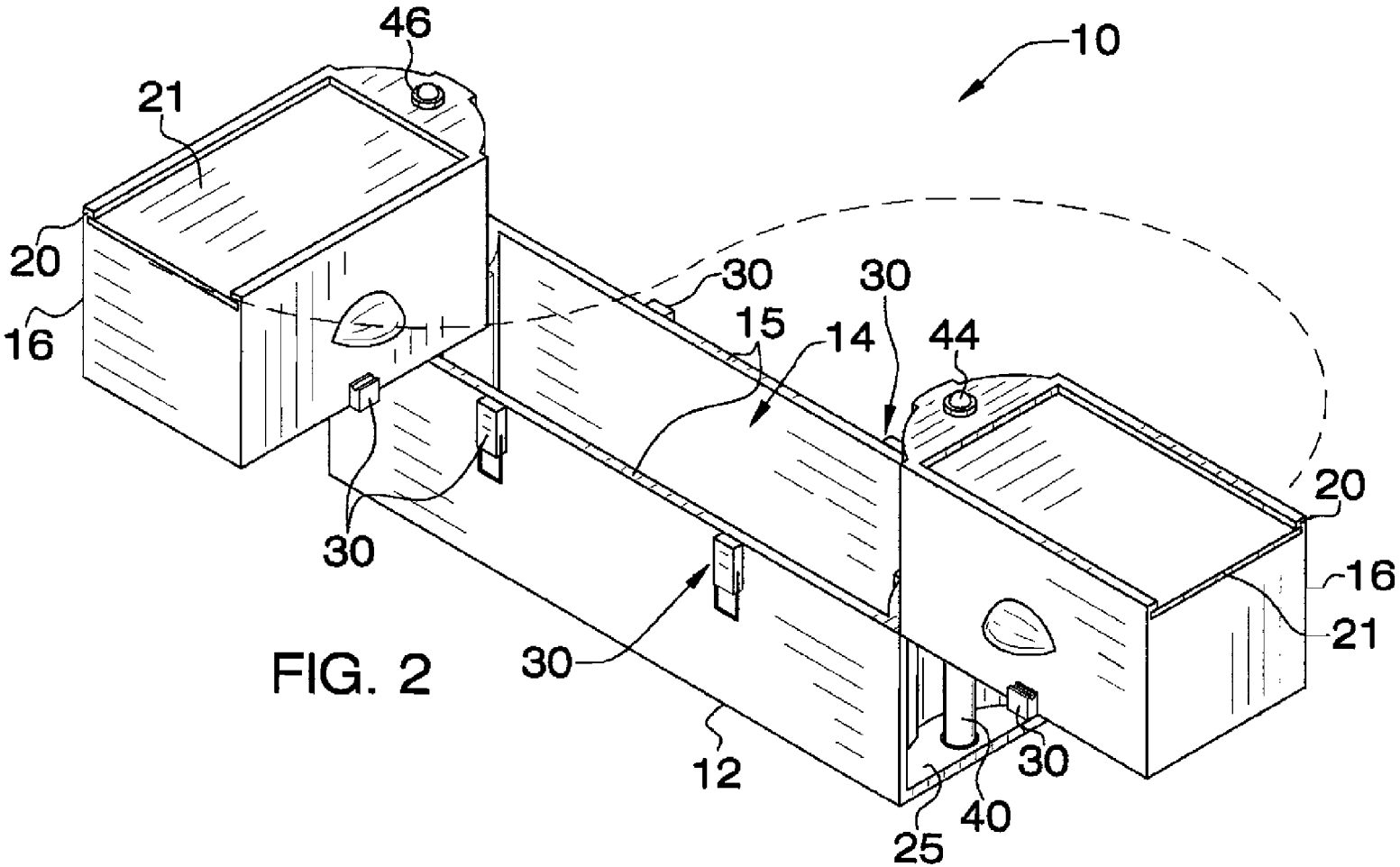
FIG. 2 is a perspective view of the partially opened apparatus.
Figure 3:
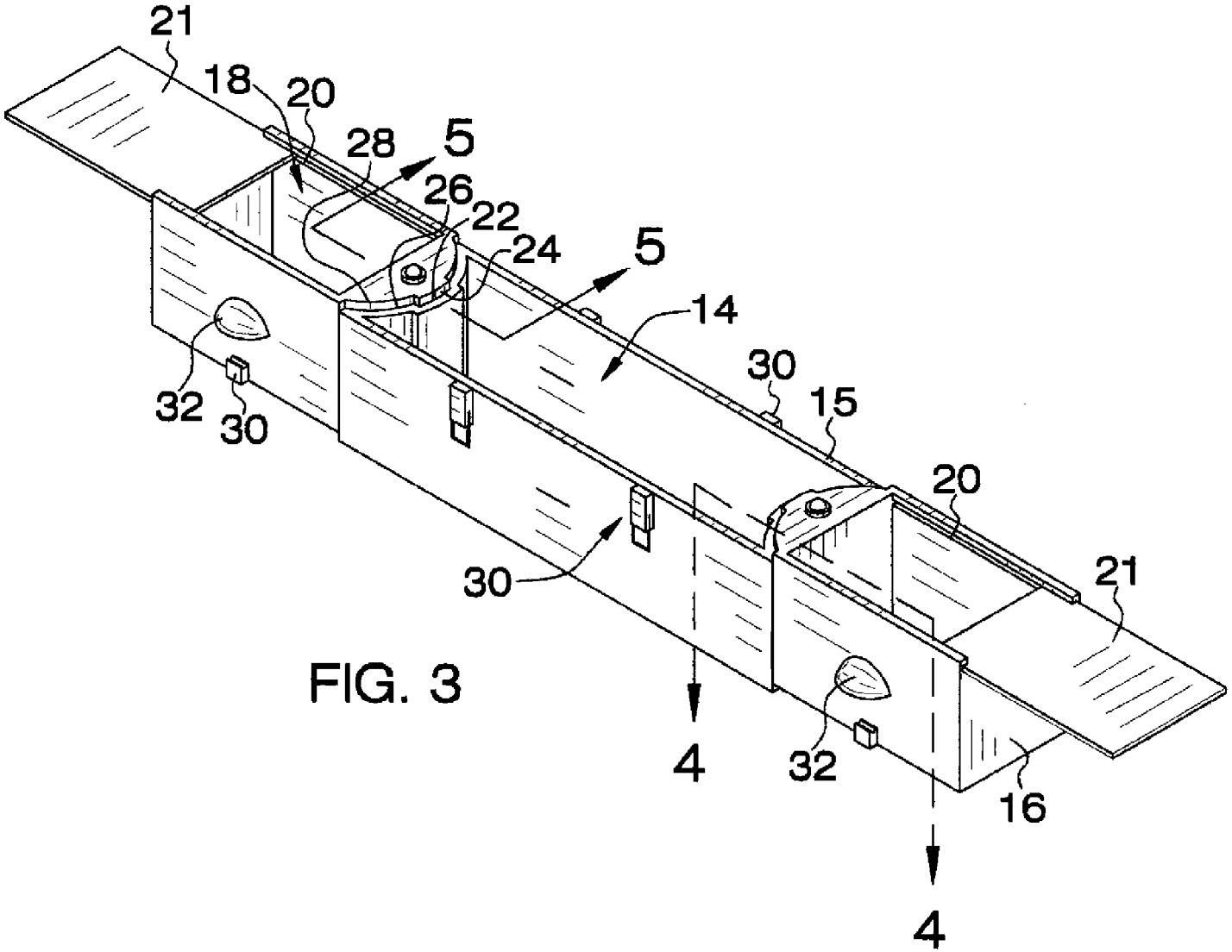
FIG. 3 is perspective view of the apparatus in the fully opened state.

Referring to FIGS. 1, 2, and 3, the pivoted tray storage apparatus 10 comprises a parallelepiped base 12. The base 12 has a bottom, two spaced apart sides, and two spaced apart ends. The base compartment 14 is formed within the bottom, sides, and ends. Each base 12 end further comprises a concave endpiece 26. Each concave endpiece 26 further comprises a channel 22 in the center of the endpiece 26. The pneumatic cylinder 40 is vertically disposed within the concave endpiece 26. The shelf 25 is extended from the bottom of the concave endpiece 26. The pneumatic cylinder 40 is vertically disposed upon the shelf 25. The base 12 is selectively topped by a pair of opposed pivoted trays 16. In the closed position for the apparatus 10, the trays 16 rest atop the base 12. The inner end of each tray 16 faces the inner end of the opposite tray 16. This positioning of the trays 16 in the closed state prevents sliding lid 21 opening. The trays 16 can be pivoted from directly atop the base 12 as chosen. Another embodiment of the base 12 lip 15 provides a bevel (not shown) with an accompanying counter bevel (not shown) on the bottom edge of each tray 16. The complimentary bevels assist in retaining the trays 16 above the base 12. A latch 30 secures each tray 16 side to each of the base 12 sides, respectively. When closed, the tray 16 convex endpieces 28 are positioned above the base 12 concave endpieces 26, thereby establishing a handle means for conveying the apparatus 10.

Figure 5:
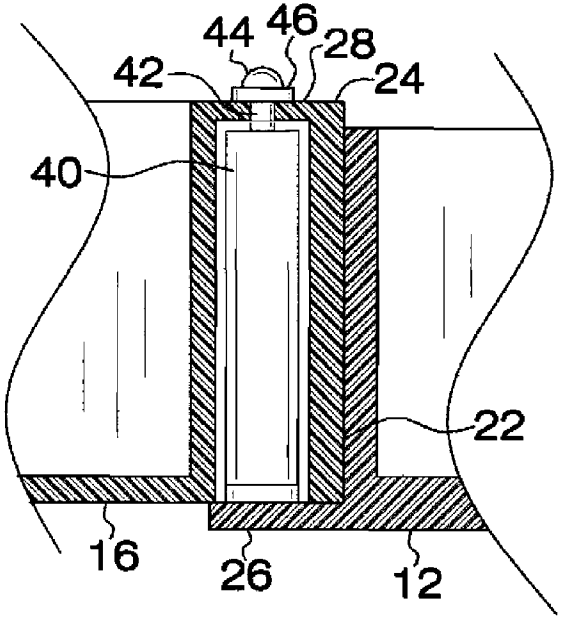
FIG. 5 is a partial cross sectional view of FIG. 3.
Figure 4:
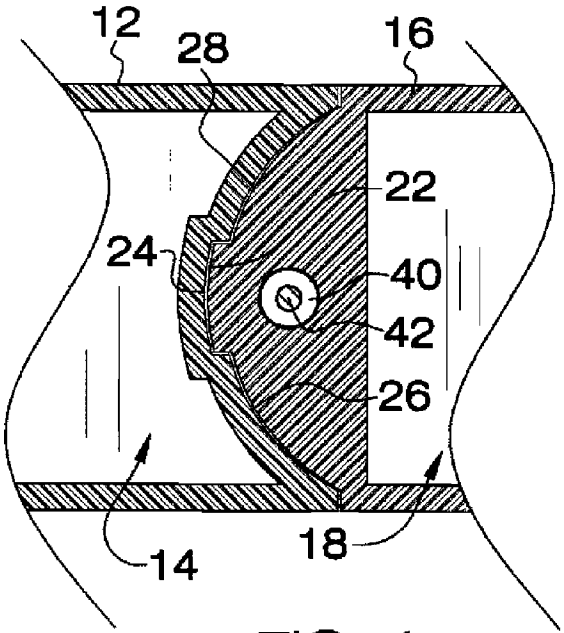
FIG. 4 is a partial cross sectional view of FIG. 3.

In view of FIGS. 4 and 5 and in further view of FIGS. 1, 2, and 3, each tray 16 comprises two spaced apart sides, an outer end and an inner end, and a bottom. A tray compartment 18 is formed within the bottom, outer end, inner end, and sides. Each outer end of each tray further comprises a convex endpiece 28. The spine 24 is disposed on the convex endpiece 28. The spine 24 of one convex endpiece 28 removably fits within the channel 22 of one of the base 12 ends. A plunger 42 is slideably fitted within each one of the pneumatic cylinders 40. A bushing 46 fits each plunger 42 to one of the convex endpieces 28. A fastener 44 retains each plunger 42 to one of the bushings 46. With trays 16 in the closed position, the convex endpiece 28 is not fitted within the concave endpiece 26. Upon opening of the trays 16 at less than 180 degrees to the length of the base 12, the each tray 16 rests atop the base 12. However, upon opening of either tray 16 to be parallel in length to the base 12, the tray 16 lowers to be substantially on the same horizontal plane as the base 12. The convex endpiece 28 of the tray 16 fits within the concave endpiece 26 of the base 12. The plunger's 42 descent into the cylinder 40 is cushioned such that the tray 16 does not slam downwardly. The convex endpiece 28 of each tray 16 is thereby selectively locked within the concave endpiece of the base 12. The convex endpiece 28 of each tray 16, in the closed position, provides handles for carrying the apparatus 10.

In further view of FIG. 3, a longitudinal groove 20 is disposed within each tray 16 side. Each groove 20 is proximal to the top inside of each tray 16 side. The groove 20 is open to the inner end of each tray 16. A sliding lid 21 is fitted within the tray grooves 20 of each tray 16 side. A handle 32 is disposed on the outside of each tray 16 side for ease in lifting each tray 16 and for ease in pivoting each tray 16.

The apparatus 10 is not limited to only a pair of trays 16 pivotally positioned atop the base 12. The apparatus 10, in other embodiments, includes a plurality of pairs of opposed pivoted trays 16. When so equipped, the first pair of trays 16 is positionable atop the base 12. Each additional pair of trays 16 is pivotally positioned atop the next lower tray 16 pair. Trays 16 are identically shaped with the exception that the first tray 16 pair is the only pair comprising spines 24. Further, a means is provided for positioning the first tray 16 pair above the base 12 and each additional tray 16 pair above the tray 16 pair below. The base 12 comprises a lip 15 bevel (not shown) on the lip 15 at a top of each base 12 side. Each tray 16 comprises a bevel (not shown) on the bottom of each tray 16 pair side. A top tray 16 bevel is disposed on the top of each tray 16 pair side. The lip 15 bevel is angled opposite each tray 16 bottom bevel. Each top tray 16 bevel is angled opposite each bottom tray 16 bevel. Trays 16 are provided in varied height dimensional embodiments. Bases 12 are also provided in various heights.

With respect to the above description then, it is to be realized that the optimum dimensional relationships for the parts of the pivoted tray storage apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the pivoted tray storage apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the pivoted tray storage apparatus may be used.

Therefore, the foregoing is considered as illustrative only of the principles of the pivoted tray storage apparatus. Further, since numerous modifications and changes will readily occur to those skilled in the art, it is not desired to limit the pivoted tray storage apparatus to the exact construction and operation shown and described, and accordingly, all suitable modifications and equivalents may be resorted to, falling within the scope of the pivoted tray storage apparatus.

What is claimed is:

1. A pivoted tray storage apparatus, comprising:

a parallelepiped base, the base having a bottom, two spaced apart sides, and two spaced apart ends;

a base compartment formed within the bottom, sides, and ends;

each base end further comprising:

a concave endpiece;

a shelf extended from a bottom of the concave endpiece;

a pneumatic cylinder vertically disposed upon the shelf;

a lip bevel on a lip at a top of each base side;

a pair of opposed pivoted trays, each tray comprising two spaced apart sides, an outer end and an inner end, and a bottom;

a tray compartment formed within the bottom, outer end, inner end, and sides;

a tray bevel on a bottom of each tray side, the tray bevel a counterpart to the base lip bevel;

each outer end further comprising:

a convex endpiece;

a plunger slideably fitted within the pneumatic cylinder of one of the base ends;

a bushing fitting each plunger to one of the convex endpieces;

a fastener retaining each plunger to one of each of the bushings;

a longitudinal groove within an inner surface of each tray side, the groove proximal to a top of the sides, the groove open to the inner end;

a sliding lid removably fitted within each tray groove;

a exterior latch securing one side of each tray to one of the base sides.

2. The apparatus in claim 1 further comprising two latches per tray, each latch on an opposite tray side.

3. The apparatus in claim 1 further comprised of a handle disposed on an outside of each tray.

4. The apparatus in claim 2 further comprised of a handle disposed on an outside of each tray.

5. The apparatus in claim 1 further comprised of a handle on an outside of each spaced apart tray side.

6. The apparatus in claim 1 further comprised of a handle on an outside of each spaced apart tray side.

7. The apparatus in claim 3 further comprising a channel within each concave endpiece;

a spine disposed on each convex endpiece, each spine for removable fit within the channel of one of the base endpieces.

8. The apparatus in claim 4 further comprising a channel within each concave endpiece;

a spine disposed on each convex endpiece, each spine for removable fit within the channel of one of the base endpieces.

9. The apparatus in claim 5 further comprising a channel within each concave endpiece;

a spine disposed on each convex endpiece, each spine for removable fit within the channel of one of the base endpieces.

10. The apparatus in claim 6 further comprising a channel within each concave endpiece;

a spine disposed on each convex endpiece, each spine for removable fit within the channel of one of the base endpieces.

11. A pivoted tray storage apparatus, comprising:

a parallelepiped base, the base having a bottom, two spaced apart sides, and two spaced apart ends;

a base compartment formed within the bottom, sides, and ends;

each base end further comprising:

a concave endpiece;

a channel within the concave endpiece;

a shelf extended from a bottom of the concave endpiece;

a pneumatic cylinder vertically disposed upon the shelf;

a pair of opposed pivoted trays, each tray comprising two spaced apart sides, an outer end and an inner end, and a bottom;

a tray compartment formed within the bottom, outer end, inner end, and sides of each tray;

each first pair tray outer end further comprising:

a convex endpiece;

a spine disposed on the convex endpiece, the spine for removable fit within the channel of one of the base endpieces;

a plunger slideably fitted within the pneumatic cylinder of one of the base ends;

a bushing fitting each plunger to one of the convex endpieces;

a fastener retaining the plunger of each of a top tray pair to one of the bushings;

a longitudinal groove within an inner surface of each tray side, the groove proximal to a top of the sides, the groove open to the inner end;

a sliding lid fitted within each groove;

a handle disposed on an outside of each tray side;

an exterior latch securing one tray side of each of the first tray pairs to one of the base sides;

an exterior latch securing one of each of the additional tray pairs atop each lower tray pair, respectively.

12. The apparatus in claim 11 further comprising two latches per tray, each latch on an opposite tray side.

13. The apparatus in claim 11 further comprised of a handle disposed on an outside of each tray.

14. The apparatus in claim 12 further comprised of a handle disposed on an outside of each tray.

15. The apparatus in claim 11 further comprised of a handle on an outside of each spaced apart tray side.

16. The apparatus in claim 12 further comprised of a handle on an outside of each spaced apart tray side.

17. The apparatus in claim 13 further comprising a lip bevel on a lip at a top of each base side;

a tray bevel on a bottom of each tray pair side;

a top tray bevel on a top of each tray pair side.

18. The apparatus in claim 14 further comprising a lip bevel on a lip at a top of each base side;

a tray bevel on a bottom of each tray pair side;

a top tray bevel on a top of each tray pair side.

19. The apparatus in claim 15 further comprising a lip bevel on a lip at a top of each base side;

a tray bevel on a bottom of each tray pair side;

a top tray bevel on a top of each tray pair side.

20. The apparatus in claim 16 further comprising a lip bevel on a lip at a top of each base side;

a tray bevel on a bottom of each tray pair side;

a top tray bevel on a top of each tray pair side.

* * * * *